US012116768B2

(12) United States Patent
Chen

(10) Patent No.: US 12,116,768 B2
(45) Date of Patent: Oct. 15, 2024

(54) BEAM-COLUMN JOINT OF PRECAST CONCRETE COLUMN AND CONSTRUCTION METHOD THEREOF

(71) Applicant: HAINAN UNIVERSITY, Hainan (CN)

(72) Inventor: Yun Chen, Hainan (CN)

(73) Assignee: HAINAN UNIVERSITY, Hainan (CN)

( * ) Notice: Subject to any disclaimer, the term of this patent is extended or adjusted under 35 U.S.C. 154(b) by 282 days.

(21) Appl. No.: 17/624,286

(22) PCT Filed: Feb. 10, 2021

(86) PCT No.: PCT/CN2021/076427

§ 371 (c)(1),
(2) Date: Dec. 31, 2021

(87) PCT Pub. No.: WO2022/160387

PCT Pub. Date: Aug. 4, 2022

(65) Prior Publication Data

US 2023/0250625 A1 Aug. 10, 2023

(30) Foreign Application Priority Data

Jan. 27, 2021 (CN) ..... 202110111269.7

(51) Int. Cl.
*E04B 1/21* (2006.01)

(52) U.S. Cl.
CPC ..... *E04B 1/215* (2013.01)

(58) Field of Classification Search
CPC ..... E04B 1/215; E04B 1/30; E04C 3/293
(Continued)

(56) References Cited

U.S. PATENT DOCUMENTS 3,562,978 A * 2/1971 Ali-Oglu ..... E04B 1/215 52/263
3,562,979 A * 2/1971 Ali-Oglu ..... E04B 1/215 52/577

(Continued)

FOREIGN PATENT DOCUMENTS

CN 203361351 U 12/2013
CN 203782893 U 8/2014

(Continued)

OTHER PUBLICATIONS

International Search Report for PCT/CN2021/076427 mailed Nov. 1, 2021, ISA/CN.

*Primary Examiner* — James J Buckle, Jr.
(74) *Attorney, Agent, or Firm* — Yue (Robert) Xu; Apex Attorneys at Law, LLP

(57) ABSTRACT

A beam-column joint of a concrete precast column and a construction method thereof, including: obtaining a hoop plate, in which an inner side of the hoop plate is provided with studs; welding a circumferential reinforcing plate in the hoop plate; arranging longitudinal bars and stirrups for bundling the longitudinal bars; pouring the upper precast column and the lower precast column with the circumferential reinforcing plates in the two hoop plates as the boundary support formwork; welding the hoop plate of the upper precast column with the hoop plate of the lower precast column; arranging a horizontal beam at the hoop plate, and connect the horizontal beam with the hoop plate. The upper precast column and the lower precast column are connected by welding hoop plate; the hoop plate is used to connect the precast column and the horizontal beam.

17 Claims, 5 Drawing Sheets

(58) Field of Classification Search
USPC ..... 52/236.7
See application file for complete search history.

(56) References Cited

U.S. PATENT DOCUMENTS

| | | | | | |
|---|---|---|---|---|---|
| 3,613,325 | A * | 10/1971 | Yee | E04B 1/20 | 52/236.8 |
| 3,867,805 | A * | 2/1975 | Mikami | E04B 1/215 | 52/848 |
| 5,809,712 | A * | 9/1998 | Simanjuntak | E04C 5/08 | 52/236.8 |
| 6,494,639 | B1 * | 12/2002 | Friend | E04B 1/215 | 403/360 |
| 8,474,204 | B2 * | 7/2013 | Pan | E04B 1/30 | 52/650.1 |
| 8,640,419 | B2 * | 2/2014 | Lee | E04C 5/0645 | 52/649.2 |
| 9,249,593 | B2 * | 2/2016 | Perko | E04B 1/2403 | |
| 10,538,907 | B2 * | 1/2020 | Dooley | E04B 2/86 | |
| 10,975,590 | B2 * | 4/2021 | Collins | E04B 1/2403 | |
| 11,098,476 | B2 * | 8/2021 | Jin | E04B 1/2403 | |
| 11,142,911 | B2 * | 10/2021 | Chen | E04C 5/0622 | |
| 2006/0059841 | A1 * | 3/2006 | Bennett | E04B 1/215 | 52/649.1 |
| 2010/0071315 | A1 * | 3/2010 | Hong | E04B 1/215 | 52/848 |
| 2011/0094182 | A1 * | 4/2011 | Kim | E04B 1/22 | 52/699 |
| 2017/0051495 | A1 * | 2/2017 | Zavitz | E04C 5/12 | |
| 2017/0356177 | A1 * | 12/2017 | Lee | E04B 1/58 | |
| 2018/0245329 | A1 * | 8/2018 | Yu | E04B 1/1903 | |
| 2019/0226206 | A1 * | 7/2019 | Yin | E04B 1/215 | |
| 2019/0226210 | A1 | 7/2019 | Yin et al. | | |
| 2019/0271144 | A1 * | 9/2019 | Zhang | E04B 1/30 | |
| 2020/0040564 | A1 * | 2/2020 | Wu | E04B 1/21 | |
| 2021/0348377 | A1 * | 11/2021 | Scott | E04B 5/43 | |

FOREIGN PATENT DOCUMENTS

| | | | |
|---|---|---|---|
| CN | 205171692 | U | 4/2016 |
| CN | 206707124 | U | 12/2017 |
| CN | 108755945 | A | 11/2018 |
| CN | 110130580 | A | 8/2019 |
| CN | 209603288 | U | 11/2019 |
| IN | 108149844 | A | 6/2018 |
| JP | 2885055 | B2 | 4/1999 |
| JP | 2012026102 | A | 2/2012 |

* cited by examiner

BEAM-COLUMN JOINT OF PRECAST CONCRETE COLUMN AND CONSTRUCTION METHOD THEREOF

This application is a National Phase entry of PCT Application No. PCT/CN2021/076427, filed on Feb. 10, 2021, claims priority of Chinese Patent Application No. 202110111269.7, titled "BEAM-COLUMN JOINT OF PRECAST CONCRETE COLUMN AND CONSTRUCTION METHOD THEREOF", filed with the China National Intellectual Property Administration on Jan. 27, 2021, which is incorporated herein by reference in its entirety.

FIELD

The present application relates to the technical field of architecture and construction, and in particular to a construction method of a beam-column joint of a precast concrete column. In addition, the beam-column joint of the precast concrete column applying the above-mentioned construction method of the beam-column joint of the precast concrete column is further provided according to the present application.

BACKGROUND

On-site construction has the disadvantages of low production efficiency, high resource waste rate, poor quality control, and large environmental impact. In order to improve production efficiency, construction quality and reduce environmental pollution, a prefabricated building has been vigorously developed in recent years.

In order to ensure the overall force performance of the prefabricated building, it is necessary to connect the components through joints so that they can bear the force together under the load. Due to the complex force mechanism of the building structure, the joints are often not in a single force state, and the joints must have sufficient strength and rigidity.

Current prefabricated concrete components mainly include dry connection and wet connection. The current dry connection construction process is complicated, and the connection quality is easily affected by materials and operation technology; the wet connection is to pour concrete after assembly, which is difficult to operate on site. Moreover, because concrete pouring requires the use of formwork, the construction process is complicated, the operation is cumbersome, and the construction requirements are high, which seriously affects the construction progress.

In summary, how to provide an economical and convenient beam-column joint of a concrete precast column and a construction method thereof is an urgent problem to be solved by those skilled in the art.

SUMMARY

In view of this, an object according to the present application is to provide a construction method of beam-column joint of concrete precast column, and the hoop plate connecting the upper precast column and the lower precast column is connected with the horizontal beam, this method is simple, economical and practical.

In addition, a beam-column joint of a concrete precast column applying the above-mentioned construction method of beam-column joint of the concrete precast column is further provided according to the present application.

In order to achieve the above object, the following technical solutions are provided according to the present application.

A construction method of beam-column joint of concrete precast column, including:

obtaining a hoop plate, where an inner side of the hoop plate is provided with studs;

welding a circumferential reinforcing plate in the hoop plate;

arranging longitudinal bars and stirrups for bundling the longitudinal bars;

pouring the upper precast column and the lower precast column with the circumferential reinforcing plates in two hoop plates as the boundary support formwork;

welding the hoop plate of the upper precast column with the hoop plate of the lower precast column;

arranging a horizontal beam at the hoop plate, and connect the horizontal beam with the hoop plate.

Preferably, the horizontal beam is a steel beam.

Preferably, an upper flange of the steel beam is welded with the hoop plate of the upper precast column, and a lower flange of the steel beam is welded with the hoop plate of the lower precast column.

Preferably, both ends of the steel beam are provided with end steel plates, the hoop plate is provided with screw mounting holes, and the steel beam and the hoop plate are fixedly connected by screw rods.

Preferably, the horizontal beam is a cast-in-place beam.

Preferably, multiple studs are arranged on an outer side of the hoop plate, and the studs are evenly distributed along a height direction of the cast-in-place beam.

Preferably, both the upper precast column and the lower precast column are provided with anchor bars penetrating the precast column, and the anchor bars are connected with the longitudinal bars of the cast-in-place beam.

Preferably, the anchor bars are connected with the longitudinal bars of the cast-in-place beam through threaded steel sleeves.

Preferably, an outer side of the hoop plate is provided with a hidden bracket, and the horizontal beam is connected with the hoop plate through the hidden bracket.

A beam-column joint of a concrete precast column, including a horizontal beam and a precast column assembled and connected by an upper precast column and a lower precast column, the lower end surface of the upper precast column and the upper end surface of the lower precast column are both provided with circumferential reinforcing plates, the hoop plate is provided on the outer side of the circumferential reinforcing plate, the hoop plate of the upper precast column is welded to the hoop plate of the lower precast column;

the outer surface of the hoop plate for connecting with the horizontal beam is provided with hidden brackets or studs, and both the hidden brackets and the studs are connected with the horizontal beam.

In the construction method of beam-column joint of the concrete precast column provided by the present application, ends of the upper precast column and lower precast column are provided with circumferential reinforcing plates, and a hoop plate is weld in an outer circumferential direction of the circumferential reinforcing plate, which ensures that the precast column has sufficient strength and rigidity at the beam-column joint, and ensures the rigidity and strength of the beam-column joint; the upper precast column and the lower precast column are connected by welding hoop plate, which has high connection strength and is easy for construction and welding, and improves the construction efficiency.

The hoop plate is used to connect the precast column and the horizontal beam, the connection method is simple and ensures the connection strength of beam-column joints, which reduces the construction difficulty and improves the construction efficiency.

In addition, a beam-column joint of a concrete precast column applying the above-mentioned construction method of beam-column joint of the concrete precast column is further provided according to the present application.

BRIEF DESCRIPTION OF THE DRAWINGS

For more clearly illustrating embodiments of the present application or the technical solutions in the conventional technology, drawings to be used in the description of the embodiments or the conventional technology will be briefly described hereinafter. Apparently, the drawings in the following description are only some embodiments of the present application. For those skilled in the art, other drawings may be obtained based on the provided drawings without any creative work.

Figure 1:
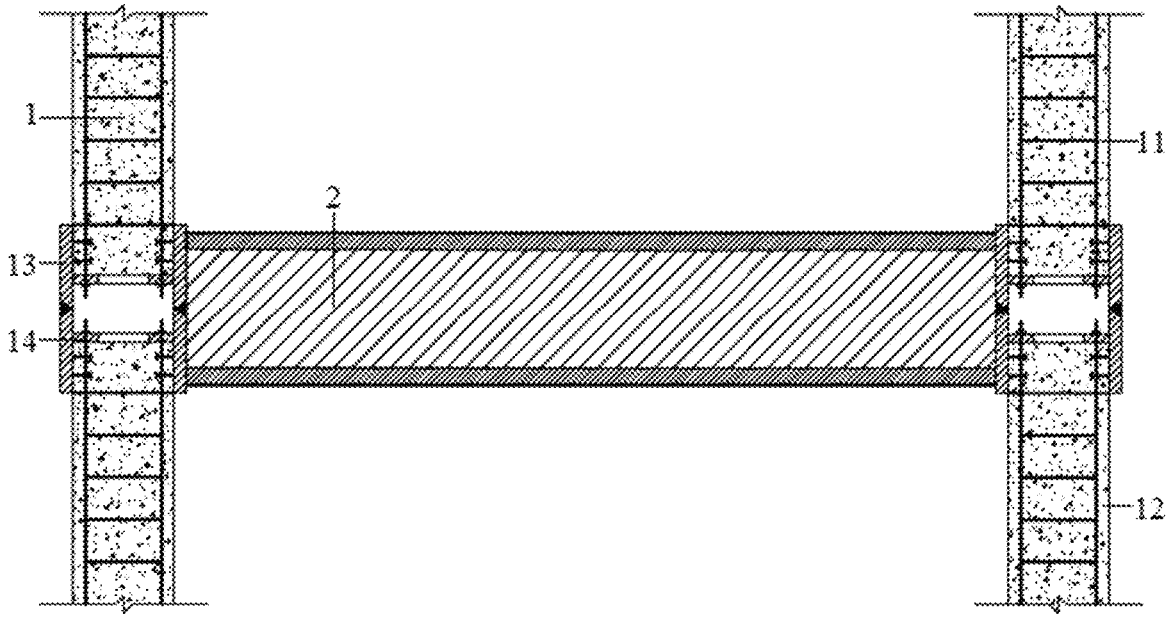
FIG. 1 is a structural schematic diagram of the concrete precast column beam-column joint in a first embodiment of the present application.

Reference numerals in FIGS. 1 to 8 are listed as follows:

1 precast column, 11 upper precast column, 12 lower precast column, 13 hoop plate, 131 stud, 132 grouting port, 14 circumferential reinforcing plate, 15 anchor bar, 2 steel beam, 21 end steel plate, 3 cast-in-place beam, 4 longitudinal beam, 5 screw rod, 6 threaded steel sleeve, 7 hidden bracket.

DETAILED DESCRIPTION OF THE EMBODIMENTS

Technical solutions of embodiments of the present application are clearly and completely described hereinafter in conjunction with the drawings of the embodiments of the present application. Apparently, the embodiments described in the following are only some embodiments of the present application, rather than all embodiments. Based on the embodiments in the present disclosure, all of the other embodiments which are obtained by those skilled in the art without any creative work fall within the protection scope of the present disclosure.

A core according to the present application is to provide a construction method of beam-column joint of concrete precast column, and the hoop plate connecting the upper precast column and the lower precast column is connected with the horizontal beam, this method is simple, economical and practical.

In addition, a beam-column joint of a concrete precast column applying the above-mentioned construction method of beam-column joint of the concrete precast column is further provided according to the present application.

Reference is made to FIG. 1 to FIG. 8.

It should be noted that, a precast column 1 in the present application refers to a structural column formed after an upper precast column 11 and a lower precast column 12 are assembled.

In the construction method of the beam-column joint of the concrete precast column provided by the present application, the construction steps include:

- step S1, obtaining a hoop plate 13, in which an inner surface of the hoop plate 13 is provided with studs 131;
- step S2, welding a circumferential reinforcing plate 14 in the hoop plate 13;
- step S3, arranging longitudinal bars 4 and stirrups for bundling the longitudinal bars 4;
- step S4, taking the circumferential reinforcing plates 14 in two hoop plates 13 as the boundary support formwork, respectively pour the upper precast column 11 and the lower precast column 12;
- step S5, welding the hoop plate 13 of the upper precast column 11 and the hoop plate 13 of the lower precast column 12;
- step S6, arranging a horizontal beam at the hoop plate 13, and connecting the horizontal beam with the hoop plate 13.

It should be noted in Step S1 that, since the hoop plate 13 is arranged around the outer circumference of the precast column 1, the shape and size of the hoop plate 13 are determined according to the design dimension of the precast column 1; in order to facilitate the connection between the hoop plate 13 and the horizontal beam, preferably, the hoop plate 13 can be formed by welding steel plates or steel pipes; in order to strengthen the connection between the hoop plate 13 and the concrete of the precast column 1, studs 131 are arranged on an inner surface of the hoop plate 13. Preferably, the studs 131 are evenly distributed along an axial direction of the precast column 1.

It should be noted in Step S2 that, setting the circumferential reinforcing plate 14 is beneficial to determining the concrete pouring range in the formwork casting process, and as the circumferential reinforcing plate 14 is connected with the hoop plate 13 in the hoop direction, the circumferential reinforcing plate 14 can strengthen the connection between the hoop plate 13 and the precast column 1. In addition to the circumferential reinforcing plate 14, vertical stiffening ribs may also be arranged inside the hoop plate 13 to further enhance the rigidity and strength at the connection joints.

Figure 7:
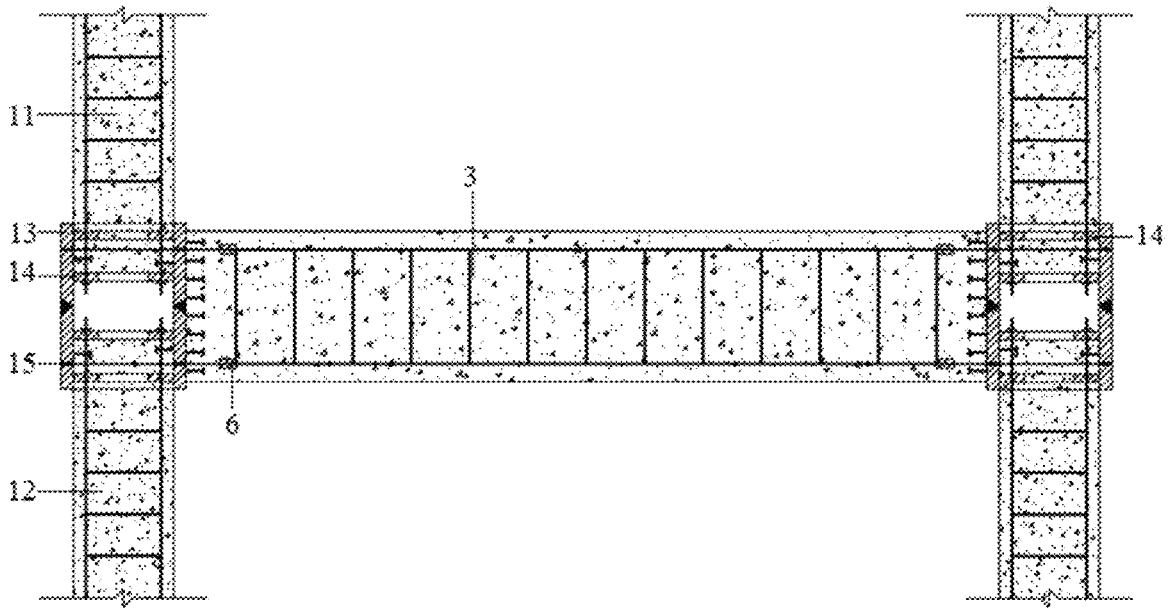
FIG. 7 is a structural schematic diagram of the concrete precast column beam-column joint in a seventh embodiment of the present application.

Referring to FIG. 1, the circumferential reinforcing plate 14 may be connected to any position of the hoop plate 13 which may not affect the pouring and production process of the precast column 1. In addition, the number of the circumferential reinforcing plate 14 is not limited to one. As shown in FIG. 7, two circumferential reinforcing plates 14 are welded into the hoop plate 13.

It should be noted that, when the number of circumferential reinforcing plate 14 is greater than or equal to 1, excluding the circumferential reinforcing plate 14 as an end plate of the precast column 1, other circumferential reinforcing plates 14 are each provided with an grouting port in the center to facilitate the pouring of concrete.

In addition, when a gap between the upper precast column 11 and the lower precast column 12 is too large, concrete can be poured into the gap through the grouting port 132 on the hoop plate 13. The lower end surface of the upper precast column 11 and the upper end surface of the lower precast column 12 are connected by concrete to further strengthen the connection of the precast column 1 at the joint.

It should be noted in Step S3 that, the longitudinal beam 4 and the stirrup constitute a steel frame of the precast column 1, and the longitudinal beam and the stirrup bear axial pressure and lateral shear respectively. The number, type and distribution of the longitudinal beam 4 and the number, type and distribution of the stirrup can be determined according to the design strength requirements of the precast column 1, which are not repeated here.

It should be noted in Step S5 that, in order to facilitate the positioning and improve the shear strength of the precast column 1, a steel pipe lining can be arranged between the lower end surface of the upper precast column 11 and the upper end surface of the lower precast column 12. The two ends of the steel pipe lining are respectively welded and connected to the circumferential reinforcing plate 14 of the upper precast column 11 and the circumferential reinforcing plate 14 of the lower precast column 12.

It should be noted in Step S6 that, the horizontal beam is fixedly connected to the hoop plate 13 of the precast column 1. The concrete connection mode between the hoop plate 13 and the horizontal beam can be determined by the type of the horizontal beam and other factors. For example, the steel beam 2 may be directly welded to the hoop plate 13 or the steel plate arranged outside the hoop plate 13; the cast-in-place beam 3 may be connected to the hoop plate 13 through the studs 131 and the anchor bar 15 on the outside of the hoop plate 13.

In this embodiment, the end surfaces of the upper precast column 11 and the lower precast column 12 are both provided with a circumferential reinforcing plate 14, and, a hoop plate 13 is circumferentially welded on the outer ring of the circumferential reinforcing plate 14, which ensures that the precast column 1 has sufficient strength and rigidity at the beam-column joint, and ensures the safety and stability of the beam-column joint; the upper precast column 11 and the lower precast column 12 are connected by welding hoop plate 13, which has high connection strength and is easy for construction and welding, and improves the construction efficiency. The hoop plate 13 is used to connect the precast column 1 and the horizontal beam, the connection method is simple and ensures the connection strength of beam-column joints, which reduces the construction difficulty, simplifies the construction process and improves the construction efficiency.

On the basis of the above embodiment, the horizontal beam may be set as the steel beam 2, which has high structural strength and simple assembly.

Referring to FIG. 1, preferably, an upper flange of the steel beam 2 is welded and connected to the hoop plate 13 of the upper precast column 11, and a lower flange of the steel beam 2 is welded and connected to the hoop plate 13 of the lower precast column 12. Therefore, the steel beam 2 is connected with the upper precast column 11 and the lower precast column 12, the connection strength at the joint is high, and the structure of the welding position is simple, and the welding construction is easy.

When performing connection, weld the upper flange of the steel beam 2 with the hoop plate 13 of the upper precast column 11; weld the lower flange of the steel beam 2 with the hoop plate 13 of the lower precast column 12; weld the web of the steel beam 2 with the hoop plate 13 of the upper precast column 11 and the hoop plate 13 of the lower precast column 12.

In addition, the web of the steel beam 2 and the hoop plate 13 of the precast column 1 may also be connected by extension plates or bolts.

Preferably, it can be set that the welding seam between the steel beam 2 and the upper precast column 11 and the welding seam between the steel beam 2 and the lower precast column 12 are symmetrically distributed about the axis of the steel beam 2.

Figure 2:
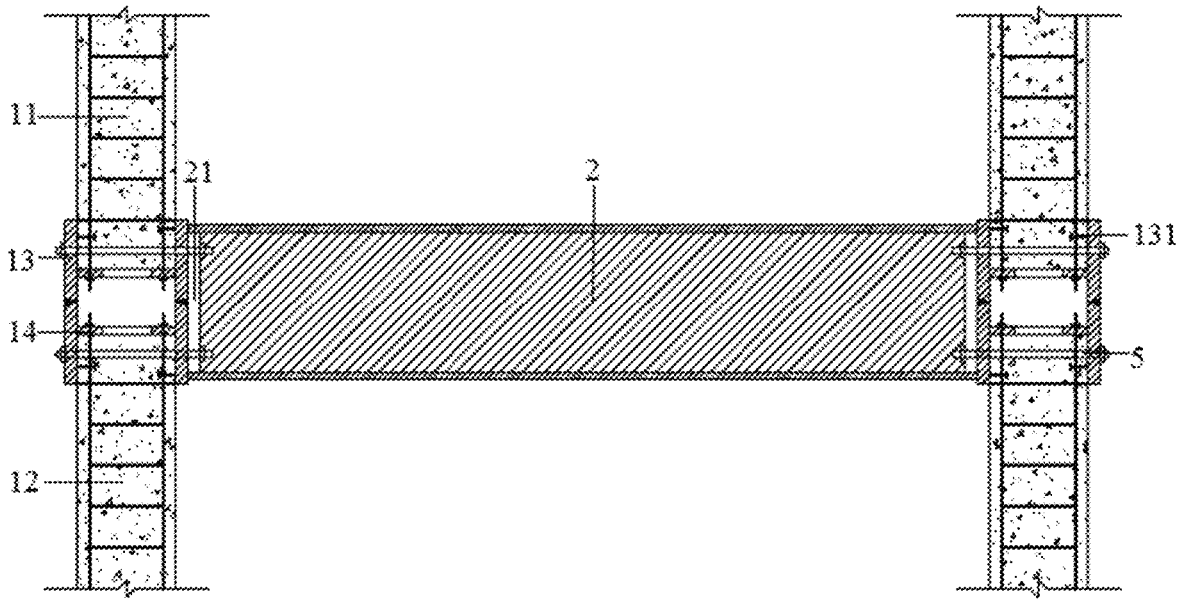
FIG. 2 is a structural schematic diagram of the concrete precast column beam-column joint in a second embodiment of the present application.

Referring to FIG. 2, preferably, both ends of the steel beam 2 are provided with end steel plates 21, the hoop plate 13 is provided with screw mounting holes, and the steel beam 2 and the hoop plate 13 are fixedly connected by screw rods 5.

During installation, one end of the screw rod 5 is bolted to the side wall surface, away from the steel beam 2, of the hoop plate 13. Another end of the screw rod 5 passes through the screw mounting hole on the side wall surface, close to the steel beam 2, of the hoop plate 13 and is connected to the end steel plate 21.

In addition, the screw rod 5 may be embedded in the hoop plate 13, when the precast column 1 and the steel beam 2 are connected, a free end of the screw rod 5 is connected with the end steel plate 21 of the steel beam 2.

On the basis of the above embodiment, the horizontal beam may also be set as the cast-in-place beam 3. After the precast column 1 is assembled, the horizontal beam is moulded and poured between two adjacent precast columns 1.

Figure 5:
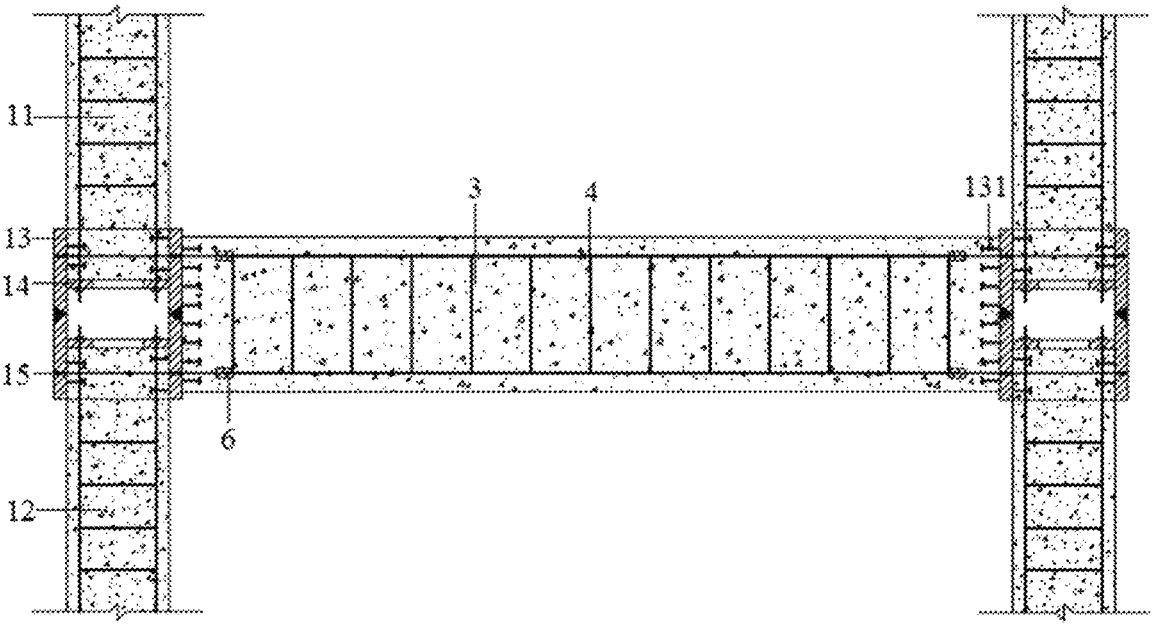
FIG. 5 is a structural schematic diagram of the concrete precast column beam-column joint in a fifth embodiment of the present application.

Preferably, referring to FIG. 5, multiple studs 131 are arranged on an outer side of the hoop plate 13, and the studs 131 are evenly distributed along the height direction of the cast-in-place beam 3, so that the studs 131 can be used to enhance the connection strength between the hoop plate 13 and the cast-in-place beam 3.

Figure 8:
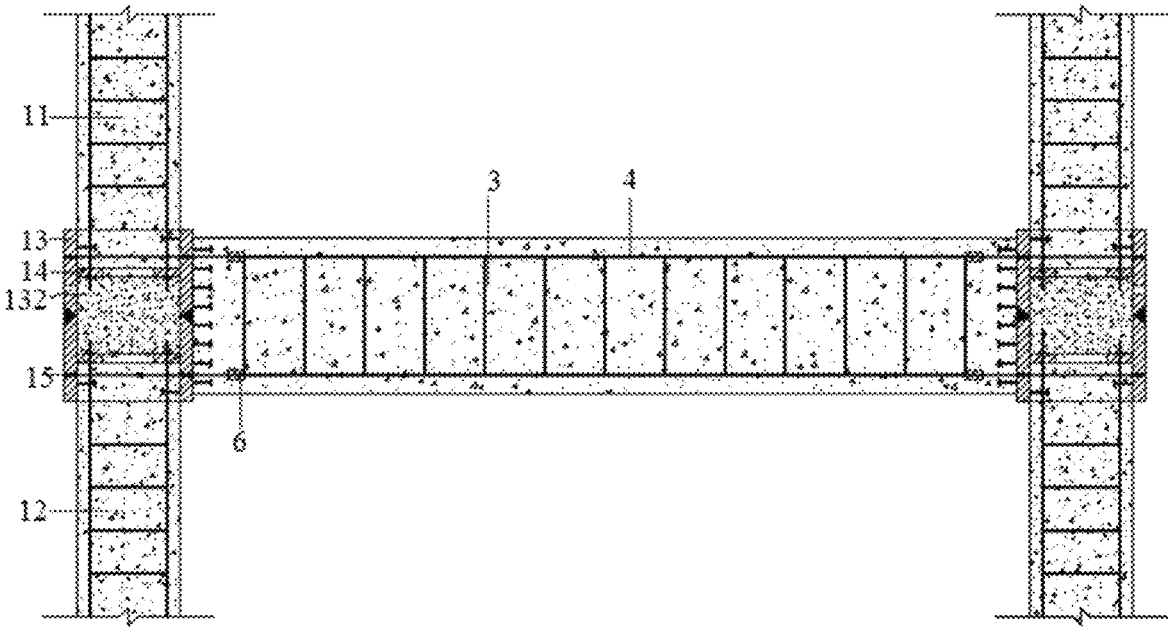
FIG. 8 is a structural schematic diagram of the concrete precast column beam-column joint in an eighth embodiment of the present application.

In order to further strengthen the connection between the hoop plate 13 and the cast-in-place beam 3, preferably, referring to FIG. 5 and FIG. 8, both the upper precast column 11 and the lower precast column 12 are provided with anchor bars 15 penetrating the precast column 1, and the anchor bars 15 are connected with the longitudinal bars 4 of the cast-in-place beam 3.

The anchor bar 15 and the longitudinal bar 4 may be directly welded and connected, may be connected by lap connection, or may be connected by other conventional steel bar connection methods.

Preferably, in order to increase the connection strength between the anchor bar 15 and the longitudinal bar 4, the anchor bar 15 may be connected to the longitudinal bar 4 of the cast-in-place beam 3 through a threaded steel sleeve 6.

On the basis of the above embodiment, the outer side of the hoop plate 13 is provided with a hidden bracket 7, and the horizontal beam and the hoop plate 13 are connected by the hidden bracket 7 to increase the connection rigidity and strength of the beam-column joint.

The hidden bracket 7 may be welded to the outer side of the hoop plate 13 after the precast column 1 is assembled, or it may be formed as an integral structure with the hoop plate 13.

Figure 3:
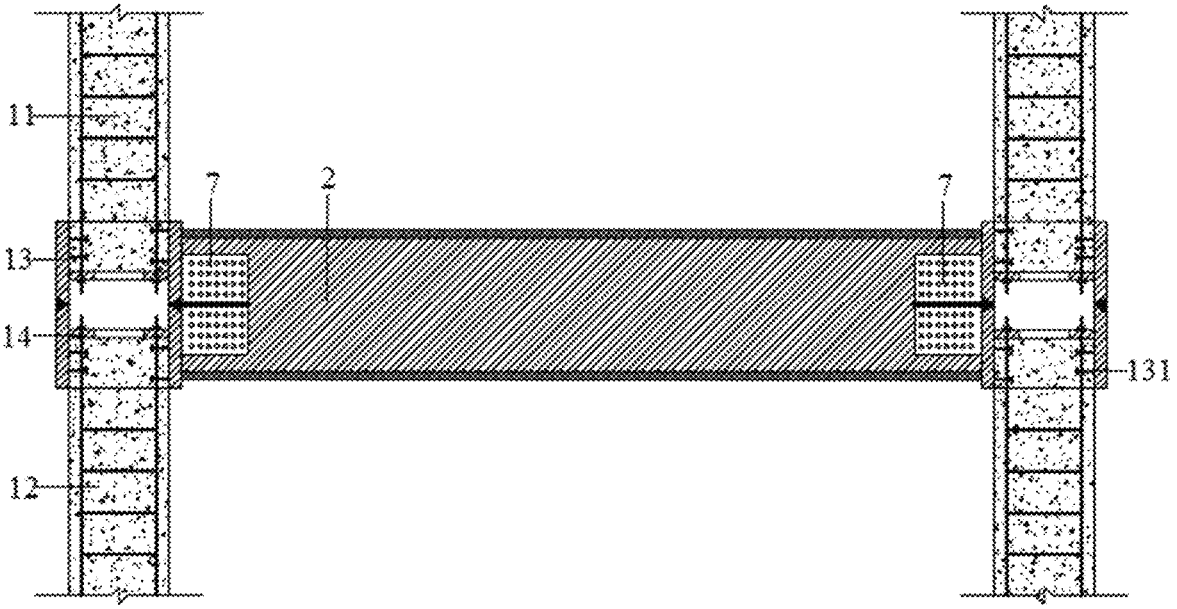
FIG. 3 is a structural schematic diagram of the concrete precast column beam-column joint in a third embodiment of the present application.
Figure 4:
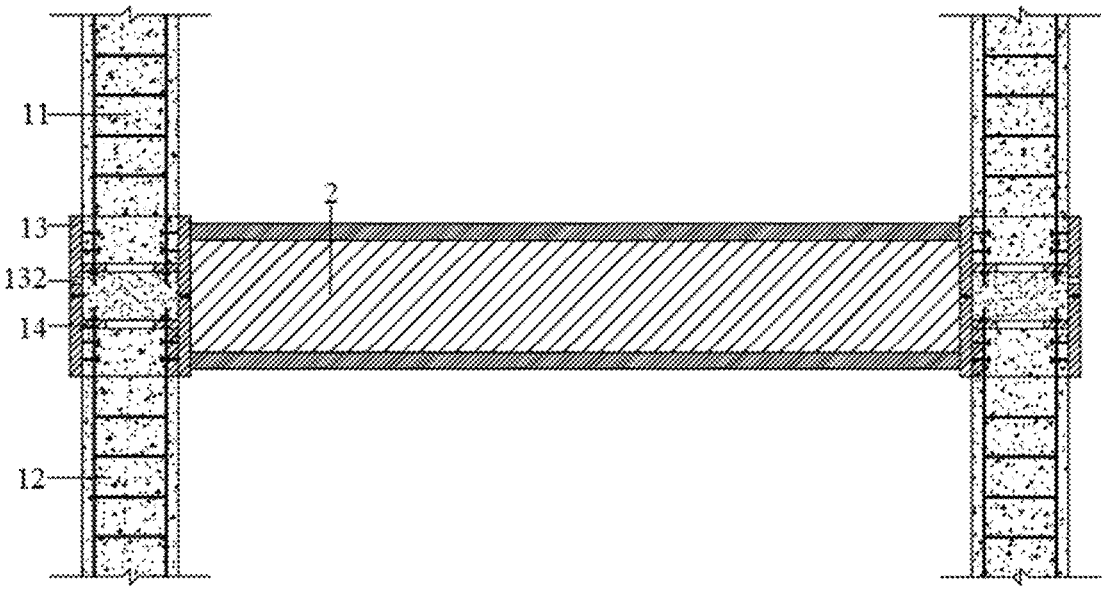
FIG. 4 is a structural schematic diagram of the concrete precast column beam-column joint in a fourth embodiment of the present application.
Figure 6:
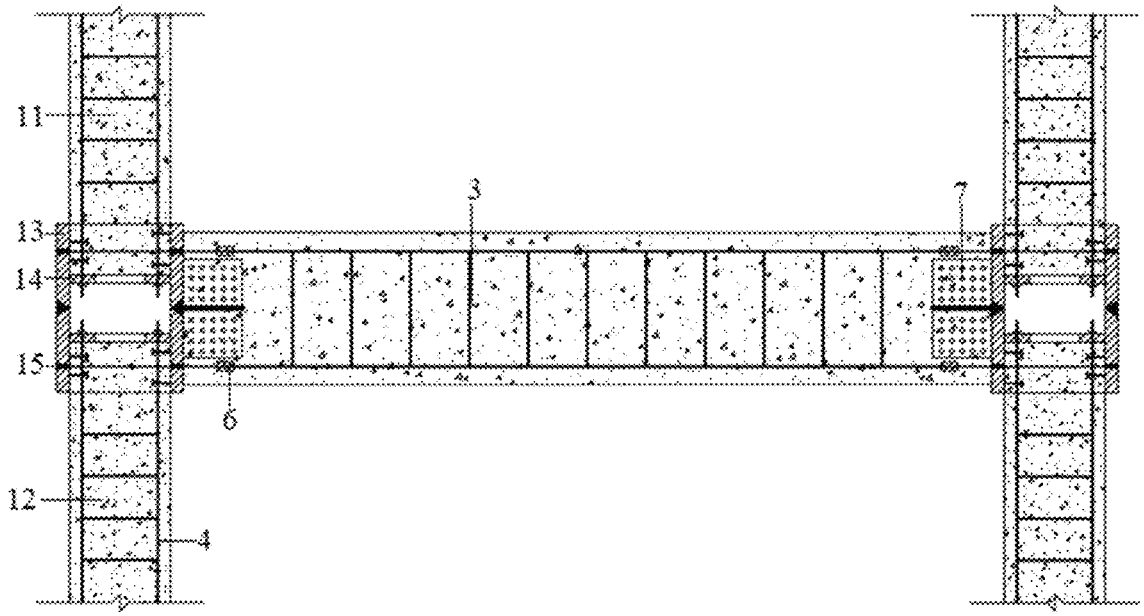
FIG. 6 is a structural schematic diagram of the concrete precast column beam-column joint in a sixth embodiment of the present application.

The hidden bracket 7 may be used to connect the precast column 1 and the steel beam 2, as shown in FIG. 3; the hidden bracket 7 may also be used to connect the precast column 1 and the cast-in-place beam 3, as shown in FIG. 6.

The number of hidden bracket 7 may be one, and the hidden bracket 7 is welded to an outer surface of the hoop plate 13 of the upper precast column 11 and the outer surface of the hoop plate 13 of the lower precast column 12 after the precast column 1 is assembled.

The number of hidden bracket 7 may also be set to two, two hidden brackets 7 are welded to the outer surface of the upper precast column 11 and the outer surface of the lower precast column 12, and the end surfaces of the two hidden brackets 7 are welded and connected.

When the upper precast column 11 and the lower precast column 12 are assembled, not only the hoop plate 13 of the upper precast column and the lower precast column must be welded and connected, but also the hidden bracket 7 must be welded to connect the upper precast column and the lower precast column, which strengthens the connection of the welding place of the precast column 1.

The size and type of the hidden bracket 7 are determined according to factors such as the height of the horizontal beam in the actual building structure, and is not repeated here.

In addition to the construction method of beam-column joint of concrete precast column, a beam-column joint using the concrete precast column disclosed in the above embodiment is further provided according to the present application, the beam-column joint of the concrete precast column includes a horizontal beam and a precast column 1 assembled and connected by the upper precast column 11 and the lower precast column 12, the lower end surface of the upper precast column 11 and the upper end surface of the lower precast column 12 are both provided with circumferential reinforcing plates 14, the hoop plate 13 is provided on the outer side of the circumferential reinforcing plate 14, the hoop plate 13 of the upper precast column 11 is welded to the hoop plate 13 of the lower precast column 12; the outer surface of the hoop plate 13 for connecting with the horizontal beam is provided with hidden brackets 7 or studs 131, and both the hidden brackets 7 and the studs 131 are connected with the horizontal beam.

Referring to FIG. 3, FIG. 5 and FIG. 6, the hidden bracket 7 and the stud 131 are welded to the outer side of the hoop plate 13, and the arrangement of the hidden bracket 7 and the stud 131 is influenced by the type of horizontal beam. For example, the studs 131 are mostly used to strengthen the connection strength between the hidden bracket 7 and concrete, and it is difficult to connect the hoop plate 13 with the steel beam 2.

It should be noted that, according to the specific types of horizontal beams, the hoop plate 13 is further provided with other connecting pieces for connecting the precast column 1 and the horizontal beam. For example, in case that the horizontal beam is a reinforced concrete beam, the anchor bar 15 is embedded in the hoop plate 13 so that the anchor bar 15 is connected to the longitudinal bars of the reinforced concrete beam.

The above embodiments are described in a progressive manner. Each of the embodiments is mainly focused on describing its differences from other embodiments, and reference may be made among these embodiments with respect to the same or similar parts.

The beam-column joint of the concrete precast column and construction method thereof provided by the present application has been described in detail above. The principle and embodiments of the present application are described through specific examples herein. The description of the above-described embodiments is merely used to facilitate understanding the method and core idea of the present application. It should be noted that, for those skilled in the art, many improvements and modifications may be further made to the present disclosure without departing from the principle of the present disclosure, and these improvements and modifications also fall within the protection scope of claims of the present disclosure.

The invention claimed is:

1. A construction method of a beam-column joint of a concrete precast column, comprising:

obtaining two hoop plates, wherein an inner surface of each of the two hoop plates is provided with studs;

welding two circumferential reinforcing plates between the two hoop plates in horizontal directions;

arranging longitudinal bars and stirrups for bundling the longitudinal bars;

pouring an upper precast column and a lower precast column with the two circumferential reinforcing plates between the two hoop plates as a boundary support formwork;

respectively welding two ends of a steel pipe lining to the circumferential reinforcing plates, wherein the steel pipe lining is arranged between a lower end surface of the upper precast column and an upper end surface of the lower precast column; and arranging a horizontal beam at the two hoop plates, and connecting the horizontal beam with the two hoop plates.

2. The construction method of the beam-column joint of the concrete precast column according to claim 1, wherein the horizontal beam is a steel beam.

3. The construction method of the beam-column joint of the concrete precast column according to claim 2, wherein an upper flange of the steel beam is welded with the hoop plate of the upper precast column, and a lower flange of the steel beam is welded with the hoop plate of the lower precast column.

4. The construction method of the beam-column joint of the concrete precast column according to claim 2, wherein both ends of the steel beam are provided with end steel plates, is provided with screw mounting holes, and the steel beam and the hoop plate are fixedly connected by screws.

5. The construction method of the beam-column joint of the concrete precast column according to claim 1, wherein the horizontal beam is a cast-in-place beam which has the longitudinal bars.

6. The construction method of the beam-column joint of the concrete precast column according to claim 5, wherein a plurality of studs are arranged on an outer surface of the hoop plate, and the studs are evenly distributed along a height direction of the cast-in-place beam.

7. The construction method of the beam-column joint of the concrete precast column according to claim 5, wherein both the upper precast column and the lower precast column are provided with anchor bars penetrating the precast column, and the anchor bars are connected with the longitudinal bars of the cast-in-place beam.

8. The construction method of the beam-column joint of the concrete precast column according to claim 7, wherein the anchor bars are connected with the longitudinal bars of the cast-in-place beam through threaded steel sleeves.

9. The construction method of the beam-column joint of the concrete precast column according to claim 1, wherein the outer side of is provided with a hidden bracket, and the horizontal beam is connected with the hoop plate through the hidden bracket.

10. A beam-column joint of a precast concrete column, comprising a horizontal beam and a precast column assembled and connected by an upper precast column and a lower precast column, wherein the lower end surface of the upper precast column and the upper end surface of the lower precast column are both provided with circumferential reinforcing plates, is provided on an outer side of the circumferential reinforcing plate, the hoop plate of the upper precast column is welded to the hoop plate of the lower precast column;

wherein the outer surface of the hoop plate for connecting with the horizontal beam is provided with hidden brackets or studs, and both the hidden brackets and the studs are connected with the horizontal beam.

11. The construction method of the beam-column joint of the concrete precast column according to claim 2, wherein the outer side of is provided with a hidden bracket, and the horizontal beam is connected with the hoop plate through the hidden bracket.

12. The construction method of the beam-column joint of the concrete precast column according to claim 3, wherein the outer side of is provided with a hidden bracket, and the horizontal beam is connected with the hoop plate through the hidden bracket.

13. The construction method of the beam-column joint of the concrete precast column according to claim 4, wherein the outer side of is provided with a hidden bracket, and the horizontal beam is connected with the hoop plate through the hidden bracket.

14. The construction method of the beam-column joint of the concrete precast column according to claim 5, wherein the outer side of is provided with a hidden bracket, and the horizontal beam is connected with the hoop plate through the hidden bracket.

15. The construction method of the beam-column joint of the concrete precast column according to claim 6, wherein the outer side of is provided with a hidden bracket, and the horizontal beam is connected with the hoop plate through the hidden bracket.

16. The construction method of the beam-column joint of the concrete precast column according to claim 7, wherein the outer side of is provided with a hidden bracket, and the horizontal beam is connected with the hoop plate through the hidden bracket.

17. The construction method of the beam-column joint of the concrete precast column according to claim 8, wherein the outer side of is provided with a hidden bracket, and the horizontal beam is connected with the hoop plate through the hidden bracket.

* * * * *